US009106013B2

(12) United States Patent
Boswell et al.

(10) Patent No.: US 9,106,013 B2
(45) Date of Patent: Aug. 11, 2015

(54) EXTERNALLY LATCHING I/O CABLE

(71) Applicant: NVIDIA CORPORATION, Santa Clara, CA (US)

(72) Inventors: Trevor Boswell, Mountian View, CA (US); Eric McSherry, San Jose, CA (US); Ravi Adusumilli, East Palo Alto, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 0 days.

(21) Appl. No.: 13/718,262

(22) Filed: Dec. 18, 2012

(65) Prior Publication Data

US 2014/0170891 A1 Jun. 19, 2014

(51) Int. Cl.
*H01R 13/627* (2006.01)

(52) U.S. Cl.
CPC ..... *H01R 13/6272* (2013.01)

(58) Field of Classification Search
USPC ..... 439/352, 357, 660, 78, 64; 361/679.32; 385/76, 58
See application file for complete search history.

(56) References Cited

U.S. PATENT DOCUMENTS

| | | | | | |
|---|---|---|---|---|---|
| 4,370,013 | A | * | 1/1983 | Niitsu et al. | 439/352 |
| 4,944,568 | A | * | 7/1990 | Danbach et al. | 385/88 |
| 5,211,572 | A | * | 5/1993 | Comstock et al. | 439/352 |
| D354,940 | S | * | 1/1995 | Speiser et al. | D13/133 |
| 5,481,634 | A | * | 1/1996 | Anderson et al. | 385/76 |
| 5,518,416 | A | * | 5/1996 | Kantner et al. | 439/352 |
| 5,572,400 | A | * | 11/1996 | Roesner et al. | 361/679.58 |
| 5,672,071 | A | * | 9/1997 | Ceru | 439/353 |
| 5,838,550 | A | * | 11/1998 | Morris et al. | 361/818 |
| 5,975,953 | A | * | 11/1999 | Peterson | 439/607.18 |
| D422,968 | S | * | 4/2000 | Tsai et al. | D13/147 |
| 6,130,977 | A | * | 10/2000 | Rosson | 385/76 |
| 6,352,444 | B1 | * | 3/2002 | Yuzawa | 439/353 |
| 6,431,901 | B1 | * | 8/2002 | Yeh | 439/357 |
| 6,755,686 | B2 | * | 6/2004 | Scherer et al. | 439/564 |
| 6,960,025 | B2 | * | 11/2005 | Gurreri | 385/58 |
| 6,983,340 | B1 | * | 1/2006 | Hermanson et al. | 710/301 |
| 7,567,434 | B1 | * | 7/2009 | Sivertsen | 361/679.32 |
| 7,839,628 | B1 | * | 11/2010 | Sivertsen | 361/679.32 |
| 8,047,854 | B2 | * | 11/2011 | Hsieh | 439/64 |
| 8,284,552 | B2 | * | 10/2012 | Sivertsen | 361/679.32 |
| 2010/0330848 | A1 | * | 12/2010 | Kondo et al. | 439/660 |
| 2012/0071012 | A1 | * | 3/2012 | Zheng et al. | 439/78 |
| 2013/0040501 | A1 | * | 2/2013 | Peng | 439/660 |
| 2013/0242497 | A1 | * | 9/2013 | Lin et al. | 361/679.32 |

* cited by examiner

*Primary Examiner* — Alexander Gilman
(74) *Attorney, Agent, or Firm* — Artegis Law Group, LLP

(57) ABSTRACT

An external latching mechanism for an Input/Output (I/O) connection between devices is provided. In one embodiment, an external latching mechanism for an Input/Output (I/O) cable is provided. The external latching mechanism includes a housing coupled to an I/O cable at a first end and having an I/O connector extending a second end. An external latch is coupled by a mounting portion to the housing. The external latch has a first end and a second end. The second end of the arm extends beyond the second end of the housing to a barb. In another embodiment, an external latching Input/Output (I/O) connection is provided that includes a I/O card latching bracket configured to mate with an I/O cable assembly.

20 Claims, 5 Drawing Sheets

EXTERNALLY LATCHING I/O CABLE

BACKGROUND OF THE INVENTION

1. Field of the Invention

Embodiments of the present invention relate generally to I/O cabling and, more specifically, an apparatus for providing a positive locked connection for I/O devices to computing devices. Said apparatus comprising an external latching mechanism which can be integrated in or added to an existing standard I/O cable and standard cable receptacle in a cost effective manner.

2. Background

Many devices connect to each other using cables typically made up of a number of wires assigned to pins located in connectors at the end of the cable. The connectors may be based on a standard with an agreed upon sizes and configurations. Some connectors are proprietary and require the original equipment manufacturer to supply replacement cables.

Certain institutions require the connections between the computing device and the I/O devices to be secure from accidental removal. Hospitals and financial institutions are examples of such institutions. Accidental removal of the I/O device may result in financial losses or in the extreme, possibly even death in those scenarios where I/O devices are providing critical medical support. To safeguard against such accidental removal of I/O cables, users have come up with simple and inventive ideas such as tying or taping the cable to the back of the computing device. Some manufacturers have come to offer secure latches for cables to ensure they are not accidentally removed from the intended coupled devices. These cables provide screws which require tools or internal spring type mechanisms which are expensive to tool for production. However, as protocols improve and devices become smaller, I/O connections have miniaturized as well. With the miniaturization of I/O devices, computers and connectors, little space is left for traditional latching mechanisms to securely attach these devices in a manner which safeguards against accidental removal.

Many of today's mini I/O connectors do not have a latching mechanism to prevent accidental disconnection of supported devices. An internal latching mechanism could potentially be used on a mini I/O connector; however this would require new designs, and new tooling for both the male connector and female receptacle. The tooling required to make connectors and receptacles is quite complicated and expensive. Also, many devices use proprietary cables to attach specialty machines to computing device. The tooling for manufacturing latching devices for the myriad of cable configurations would be cost prohibitive. Therefore there is a need in the art for an external latching mechanism which can secure existing standard or proprietary I/O cables to a computing device.

SUMMARY OF THE INVENTION

Embodiments of the invention include external latching mechanisms for Input/Output (I/O) connections between devices. In one embodiment, an external latching mechanism for an Input/Output (I/O) connection is provided that includes a housing coupled to an I/O cable at a first end and an I/O connector extending from a second end. An external latch is coupled by a mounting portion to the housing. The external latch has a first end and a second end. The second end of the arm extends beyond the second end of the housing to a barb.

In another embodiment, an external latching Input/Output (I/O) connection is provided that includes an I/O card latching bracket configured to mate with an I/O cable assembly. The I/O card latching bracket is configured for coupling to an I/O card. The I/O latching bracket includes a plurality of cable receiving openings having a linear alignment, and plurality of latch receptacles having a linear alignment that is parallel to and spaced from the plurality of cable receiving openings. The I/O cable assembly includes an I/O cable, a housing, an I/O connector and an arm configured to allow the barb to engage the latch receptacle when the I/O connector is inserted into the cable receiving opening associated with the latch receptacle.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

For clarity, identical reference numbers have been used, where applicable, to designate identical elements that are common between figures. It is contemplated that features of one embodiment may be incorporated in other embodiments without further recitation.

DETAILED DESCRIPTION

Embodiments of the invention include the an external latching mechanism which allows the use of standard, non-latching male connectors and female receptacles. Some embodiments may be integrated into cables and receptacles of I/O cards, while other embodiments may be added to existing cables and I/O cards. In at least some embodiments, the latching mechanism is incorporated with a housing that is external to the connector/receptacle, which reduces new tooling requirement and provides additional cable retention while using off-the-shelf connectors/receptacles that are ubiquitous, and for which tooling is readily available. Advantageously, the invention may be adapted for use in just about any connector (current and future) for which an internally latching version is not available, such as Mini DP, HDMI, mHDMI, and USB, among others.

An internal latching mechanism could possibly be used on a Mini Display Port connector; however this would require new designs, and new tooling for both the male connector and female receptacle. The tooling required to make such internally latching connectors and receptacles is quite complicated and expensive. Although a new housing and bracket is required for the invention described herein, the invention described below is much less expensive to implement than making a new custom internal connector and receptacle. Thus, a new cable having the inventive external latching mechanism may be adapted for use with an existing standard connector and an external custom housing with the latching feature at significant savings while providing a secure connection not currently available in conventional designs.

Figure 1:
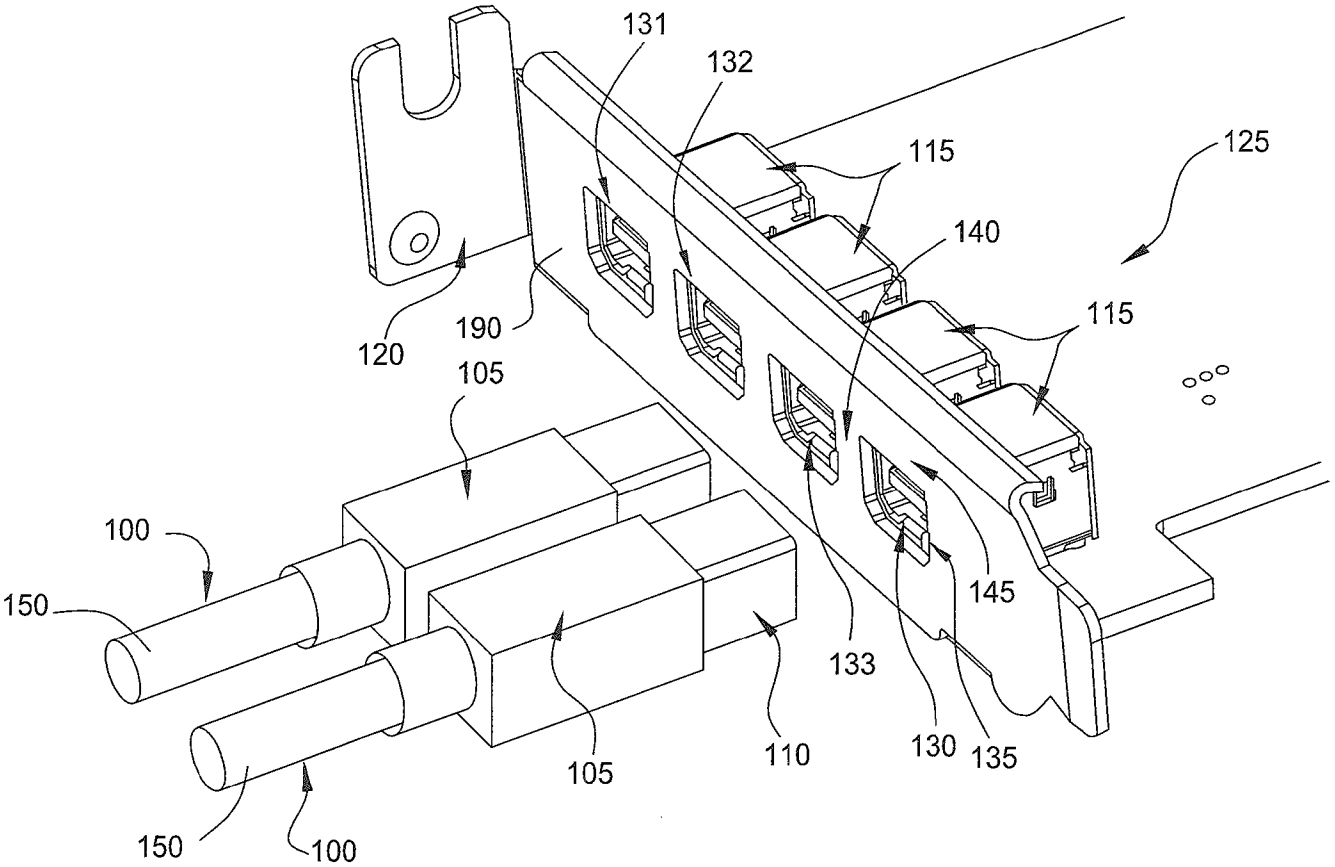
FIG. 1 illustrates a conventional Input/Output cable configuration along with a conventional receptacle on an Input/Output card.

FIG. 1 illustrates a conventional Input/Output (I/O) cable assembly 100 along with a conventional receptacle on an I/O card 125. The I/O card has standard I/O receptacles (e.g., port) 115 and a conventional I/O bracket 120. The I/O bracket 120 has a substantially planar face 190 though which a plurality of connector receiving openings 130, 131, 132 and 133 are formed. The connector receiving openings 130, 131, 132 and 133 may also be collectively referred to as openings 135 for ease of explanation. The planar face 190 of the I/O bracket 120 includes a bracket wall 140 defined between the openings 130 and 133.

Two identical standard I/O cables assemblies 100 are show in FIG. 1. The standard I/O cables assemblies 100 have a conventional cable 150, a conventional housing 105 and a standard connector 110. The standard I/O receptacle 115 is configured as a female port to receive the male standard I/O connector 110.

The I/O card 125 may be a proprietary design, or based on an industry standard. The I/O cable assemblies 100 generally provides communication from external devices to a digital device in which the I/O card 125 is mounted. For example, an I/O card 125 may be a video card. The video card may be configured to support one or more display devices. Two display devices may be connected to the video card with the standard I/O cable assemblies 100. The digital display may have a display port which interfaces with the video card having the mini display ports standard I/O receptacles 115. The conventional I/O bracket 120 has four openings for receiving I/O cable connectors. The conventional I/O bracket 120 is designed such that the bracket wall 140 is wide enough to provide sufficient spacing between the openings 133 and 130 such that the conventional I/O cable housing 105 for the standard I/O cable 100 does not impinge upon standard I/O cable 101.

The I/O devices may be an array of peripherals which are required to interface with a host computing device. The host computing device may not have built-in support for the I/O devices and require one or more I/O cards 125 to provide such support. Multiple devices supported on a single I/O card 125 may require multiple standard I/O receptacles 115. The standard I/O receptacles must be configured in a manner such that the standard I/O cable assemblies (for example 100) must not physically interfere with each other. The shrinking of the computing devices and the number of I/O connections have provided the driver for many standard connectors 110 to become smaller or miniaturized.

As discussed above, certain industries require that uninterrupted communication is provided between devices. As computing devices become smaller and as instrumentation and monitoring equipment become more complex, I/O connectors 110 have become smaller as well, and the area needed to provide secure connections is not generally available to implement conventional solutions. Additionally, costs associated with I/O device latches must be kept in check in order to viably compete in the world marketplace.

Figure 2:
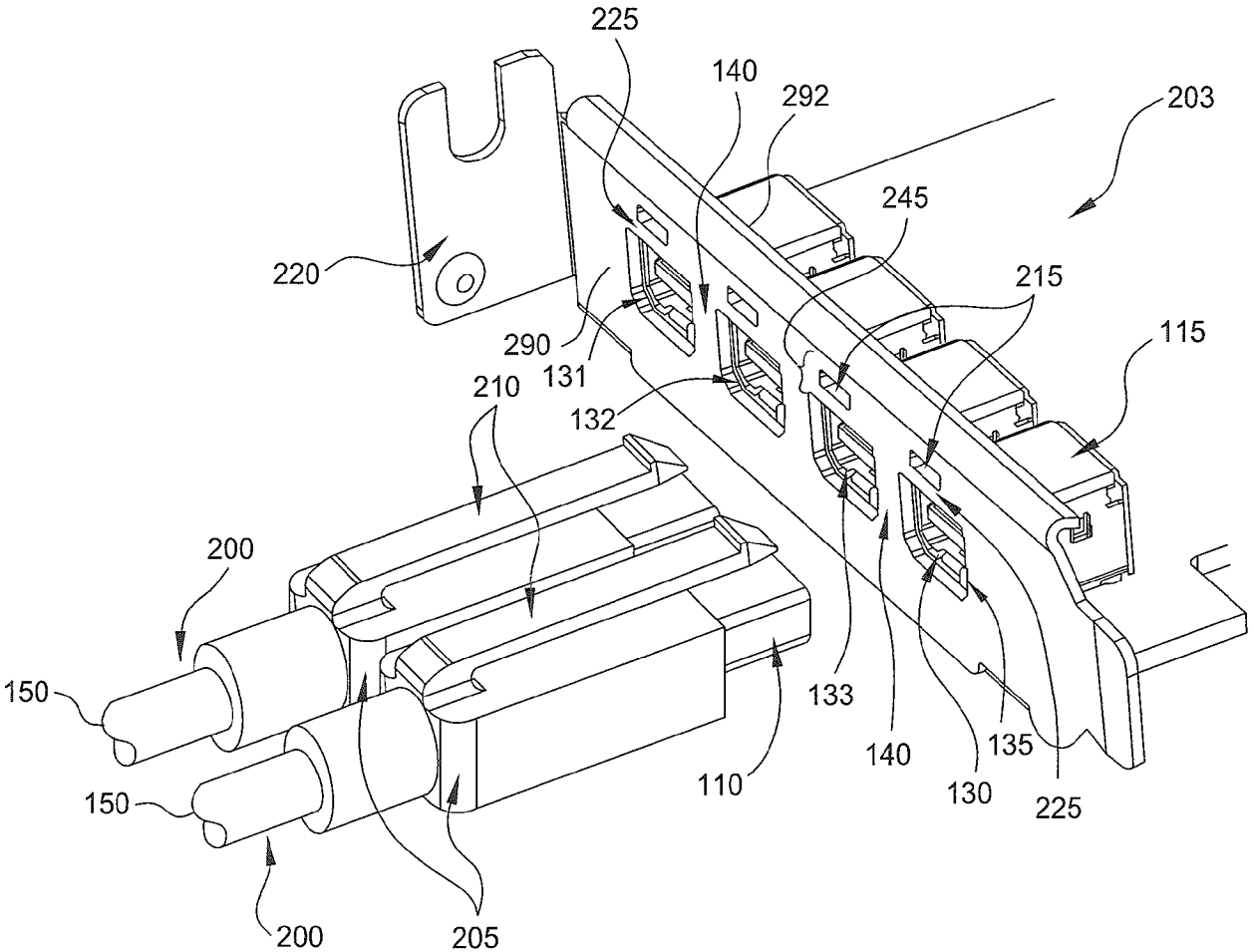
FIG. 2 illustrates an externally latching Input/Output cable configuration along with a paired receptacle on the Input/Output card illustrated in FIG. 1, according to one or more embodiments of the invention.

FIG. 2 illustrates externally latching Input/Output cable assembly 200 along with an Input/Output card 203, according to at least one embodiment of the invention. The I/O card 203 is substantially the same as the I/O card 125 described with reference to FIG. 1 except in that the I/O card 203 includes an I/O latching bracket 220 configured to secure the connection of the I/O card 203 with the cable assemblies 200 having an external latch 210. For example, the I/O card 203 may be a video card, or other suitable device. The I/O latching bracket 220 has a substantially planar face 290 through which a plurality of latch receptacles 215 and a plurality of connector receiving openings 135 are formed. Although the openings 135 are illustrated as only four connector receiving openings 130, 131, 132, 133 in FIG. 2, it is contemplated that the I/O latching bracket 220 may be configured to have more or less than four openings. The openings 135 may be linearly aligned or arranged in another orientation. Each of the openings 135 is associated with a respective one of the latch receptacles 215.

Each of the latch receptacles 215 is configured to mate with a respective one of the external latches 210 of the I/O cable assemblies 200 in a manner that allows the I/O cable assemblies 200 to be releasably secured to the I/O card 203. The latch receptacles 215 may be linearly aligned or arranged in another orientation. In at least one embodiment, the latch receptacles 215 and openings 135 are arranged in a parallel, linear orientation. The planar face 290 includes a bracket wall 225 defined between each latch receptacle 215 and the associated the bracket opening 135. Since the latch receptacle 215 is not formed through the bracket wall 140 defined between the bracket opening 135, the latch receptacle 215 provides room of the external latches 210 without interfering with the I/O card 125 or the I/O receptacles 115, and without reducing the density of cable spacing.

In some embodiments, the latching I/O bracket 220 may be an original component of the I/O card 203. In some other embodiments, the latching I/O bracket 220 may replace the conventional I/O bracket 120 on a conventional I/O card 125 and transform the I/O card 125 into I/O card 203 configured to secure the I/O cable assemblies 200.

Although only two latching I/O cables (200) are shown in FIG. 2 to avoid drawing clutter, each I/O receptacle 115 of the I/O card 203 is able to receive a separate cable. In at least one embodiment of the invention, the latching I/O cable assembly 200 is connected to one receptacle 115 of the I/O card 203 through the opening 130 and another latching I/O cable assembly 200 is connected to one receptacle 115 of the I/O card 203 through the opening 133.

Latching I/O cable assembly 200 includes an externally latching I/O cable housing 205 coupled to a cable 150. The externally latching I/O cable housing 205 includes the external latch 210. When the external latching cable assemblies 200 is placed in the bracket opening 133, the external latch 210 aligns and slides into the latch receptacle 215 as further discussed below.

The externally latching I/O cable housing 205 and the external latch 210 may be manufactured as a single unitary component or as separate components. In one embodiment, the externally latching I/O cable housing 205 is manufactured as a single component and fabricated from a polymer, such as a hard plastic or rubber material. In another embodiment, the externally latching I/O cable housing 205 may be fabricated from a material softer than a material comprising the external latch 210. For example, the externally latching I/O cable housing 205 may be over-molded with a harder material comprising the external latch 210. In another embodiment, the externally latching I/O cable housing 205 is removable from the I/O cable 105.

Opening 130, 131, 132,133 are spaced apart to define a bracket wall 140 on the face 290 between the openings. The bracket wall 140 defined on the face 290 of the I/O latching bracket 220 may have the same width as the bracket wall 140 of the conventional bracket 120 described above, which allow the exterior latching I/O cable assemblies 200 to solidly connect to the I/O card 203 without interfering with each other, other connections to the computing device, or with other equipment. Therefore, the I/O latching bracket 220 is capable of accommodating the same number of exterior latching I/O cable assemblies 200 as a conventional bracket 120 accommodates standard I/O cables 100. That is, both brackets 120, 220 may support the same number of cable connections.

The external latch 210 inserts into and engages the latch receptacle 215 to secure the cable assembly 200 from accidental disengagement from the I/O card 203. The latch receptacle 215 is positioned orthogonal from the opening 130 relative to the adjacent opening 133. The latch receptacle 215 may be elongated, but may alternatively have variety of shapes and sizes. The latch receptacle 215 fits in an area 245 of the face 290 defined between the opening and a lateral edge 292 of the face 290 adjacent the opening of the latching I/O bracket 220. In this configuration, the external latch 210 and the latch receptacle 215 do not occupy a space between the openings so that the width of the bracket wall 140 may be minimized to maximize the number of additional I/O cables 200 that can be coupled to the I/O card 203.

In one embodiment, the latching I/O bracket 220 is nearly identical in shape and size as the conventional I/O bracket 120 except for the presence of the latch receptacles 215. The latching I/O bracket 220 is configured with a number of openings 135 corresponding to the number and location of receptacles 115. Conventional I/O bracket 120 is typically attached to the I/O card 125 with screws to afford easy removal. Thus, the latching I/O bracket 220 may replace the conventional I/O bracket 120 to transform any I/O card 125 to the I/O card 203. Accordingly in at least one embodiment of the invention, the latching I/O bracket 220 is used to replace a conventional I/O bracket 120 on an I/O card 125, transforming the I/O card 125 to an I/O card 203 without replacing costly card circuitry. The use of the latching I/O bracket 220 allows for the computing device to securely connect the same number of I/O devices to the I/O card 203 without fear of a disconnection.

There are available I/O cables 100 that use screws external to the connector 110 for added retention. However, the screws are difficult to use, especially in the tight spaces where these I/O cables 100 are typically used. In many cases, the screws require more space on the I/O bracket than is available per industry standards and/or customer requirements. The externally latching I/O cables of the present invention provide latching functionality to be added to I/O cables, without the need to modify the connector or receptacle, and without need of a completely new I/O card. That is, an I/O cable 100 conventional housing 105 can be modified to incorporate an external latch 210 while the I/O card may be adapted to incorporate latch receptacles 215 thereby enabling continued use of standard and proprietary connectors.

The externally latching I/O cable 200 may incorporate many of the standard I/O connectors 110 currently available in the marketplace, such as HDMI™ and Mini DP™, for example. In one embodiment of the invention, a conventional cable 100 configured as a MINI DISPLAY PORT™ cable may be replaced or modified to include an external latch 210, thus configuring the cable 200 as a latching MINI DISPLAY PORT™ cable which provides secure uninterrupted connection to I/O card 203. However, the potential application of the externally latching I/O cable housing 205 design extends beyond just graphics card products, and beyond currently available standard I/O connectors 110.

Figure 3:
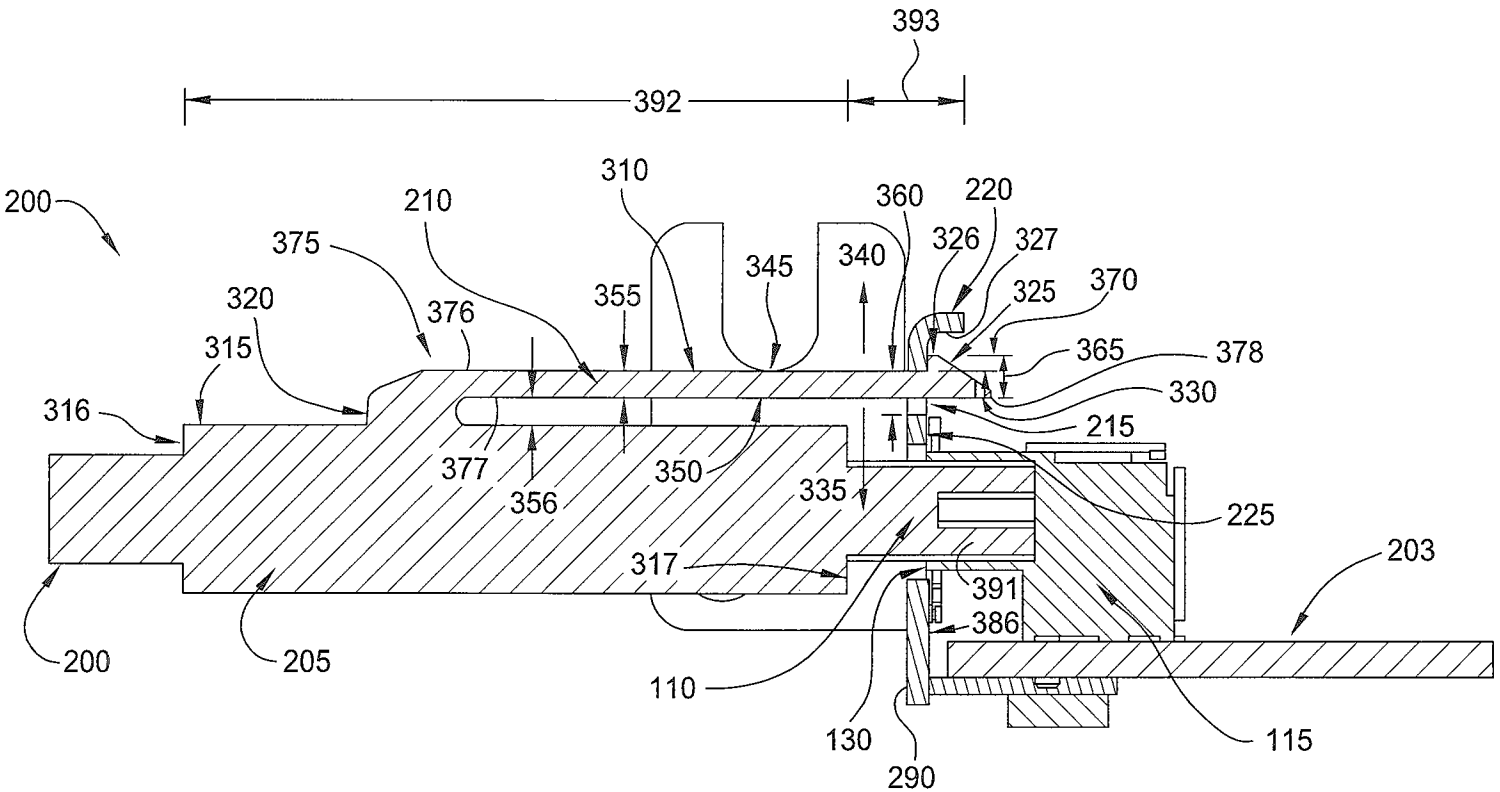
FIG. 3 illustrates a cross-sectional view of the externally latching I/O cable and receptacle of FIG. 2.

FIG. 3 illustrates a cross-sectional view of the externally latching I/O cable 200 mated with the latching receptacle 215, according to embodiments of the invention. The exterior latching I/O cable housing 205 of the externally latching I/O cable 200 has a cable end 316 and a connector end 317, wherein an overall length 392 of the housing 205 is defined between the cable end 316 and the connector end 317. The connector 110 extends from the connector end 317 of the housing 205 and is smaller in sectional area compared to the housing 205. The external latch 210 of the I/O cable assembly 200 is coupled to a housing top surface 315 of the exterior latching I/O cable housing 205.

The external latch 210 has a mounting base 320, a resilient latch arm 310, and a barb 330. A proximal end 375 of the latch arm 310 is coupled to the mounting base 320. The mounting base 320 is coupled to the housing 205. The latch arm 310 extends from the mounting base 320 to the barb 330 in a cantilevered orientation. The latch arm 310 has a thickness 355 defined between a top surface 345 and a bottom surface 350 of the latch arm 310. The bottom surface 350 of the latch arm 310 is spaced from the housing top surface 315 by a distance 356. The thickness 355, sectional geometry and material of the latch arm 310 are selected such that the latch arm 310 may be deflected resiliently upon application of an external force, displacing the cantilevered barb 330 towards the connector 110 upon application of sufficient force, and allowing the cantilevered barb 330 to move away from the connector 110 and back to a rest position upon the removal of the external force, as indicated by arrows 340 and 335.

The barb 330 includes a lip 326 and a sloped surface 325. The lip 326 extend laterally away from a first side 376 of the latch arm 310 facing away from the housing 205 and terminates at one end of the sloped surface 326. The sloped surface 326 extends away from the mounting base 320 and terminates at a second side 377 of the latch arm 310 that faces the housing 205, thereby defining a point 378 of the barb 330. The point 378 of the barb 330 extends a distance 393 beyond the connector end 317 to ensure that the barb 330 engages and mates with the latch receptacle 215 formed in the latching bracket 220 of the I/O card 203 upon insertion of the connector 110 into the receptacle 115.

The barb 330 has a barb height 365 that is less than a height 360 of the latch receptacle 215 formed through the latching bracket 220 of the I/O card 203, thereby allowing the barb 330 to enter the latch receptacle 215 when the I/O cable assembly 200 is mated with the I/O card 203. The difference between the barb height 365 and the thickness 355 defines a length 370 of the barb lip 326. The length 370 of the barb lip 326 is selected to provide a surface that locks against a back surface 327 of the face plate 290 as to prevent the connector 110 from becoming inadvertently disengaged from the I/O card 203.

When the barb 330 of the I/O cable assembly 200 is inserted into the latch receptacle 215, the sloped surface 325 contacts the surfaces of the face 290 surrounding the latch receptacle 215, thereby causing the latch arm 210 to deflect and allow the barb 330 to enter the latch receptacle 215. Once the barb 330 is through the face 290 and the connector 110 is mated with the receptacle 115, sloped surface 325 is no longer engaged with the I/O housing bracket 220, thereby removing the force that had displace the latch arm 210 and allowing the latch arm 210 to spring back to its original position and leaving the lip 326 engaged with the back surface 327 of the I/O housing bracket 220 and thus securely locking the I/O cable assembly 200 to the I/O card 203.

To remove the I/O cable assembly 200 to the I/O card 203, the latch arm 210 is manually displaced thereby allowing the lip 326 to pass out the latch receptacle as the I/O cable assembly 200 is disengaged from the I/O card 203.

The externally latching I/O cable 201 has several advantages over other conventional I/O cables 100. The external latch 210 provides secure mechanical retention of I/O cables 200 to the I/O card 203 without altering connector 110 or receptacle 115. The external latch 210 can be universally incorporated into a variety of standard I/O cable designs (current and future). The addition of the external latch 210 is compliant with most if not all industry specifications and can be used with many existing proprietary designs. The external latch 210 is also easy to engage and disengage without the use of tools which makes it ideal for use in confined and/or difficult to access spaces.

Although the I/O cable assembly 200 depicted in FIG. 3 illustrates the external latch 210 on a top 315 of the housing 205, the external latch 210 may alternatively reside on other sides of the housing 205. It is also contemplated that the configuration of the barb 330 may vary, for example such that the orientation of the sloped surface 325 is rotated to cause a lateral or opposite movement of the arm 310 to lock and/or unlock the I/O cable assembly 200 from the I/O card 203.

Figure 4:
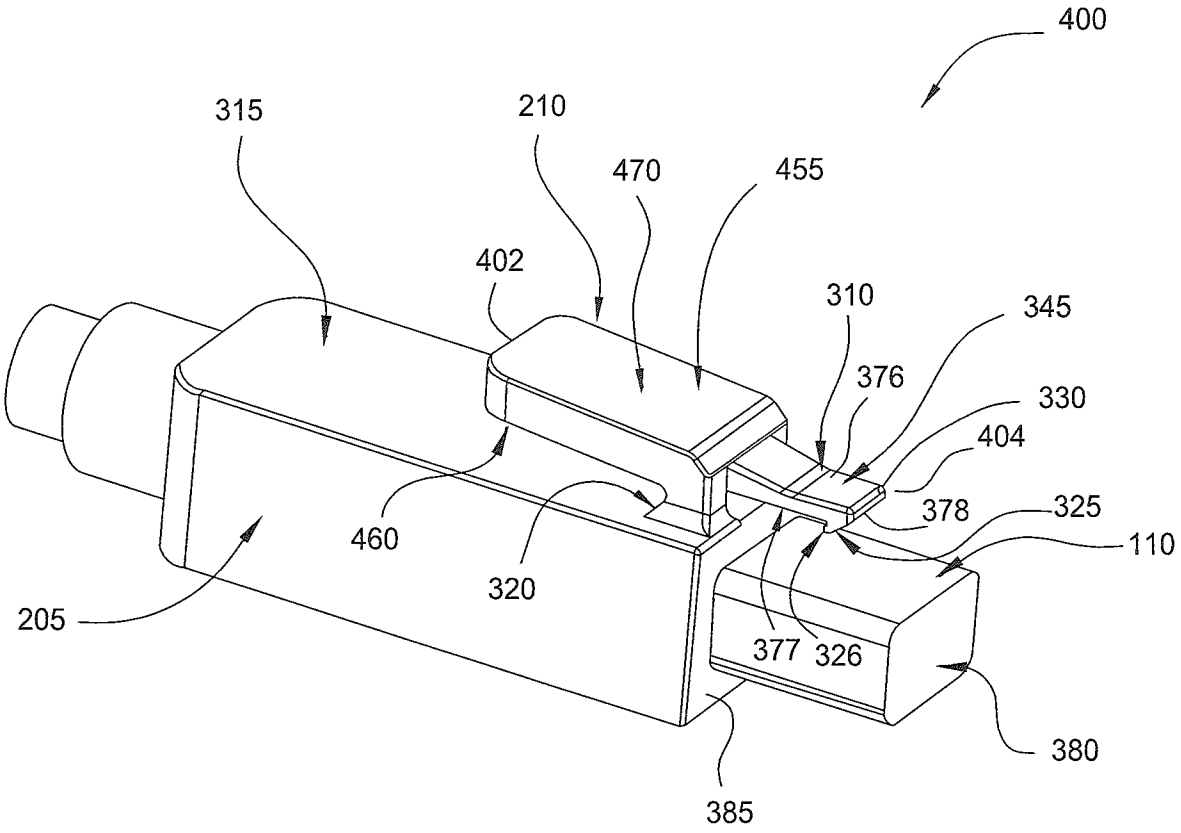
FIG. 4 illustrates an alternative latching mechanism for an I/O cable, according to one or more embodiments of the invention.

FIG. 4 illustrates an alternative embodiment of an external latch 210 for an I/O cable 400, according to at least one embodiment of the invention. The I/O cable 400 includes an external latching I/O cable housing 205 to which the external latch 210 is coupled. The external latch 210 includes a latch arm 455 having barb 330 that may be utilized to releasably secure the I/O cable 400 to an I/O card 203.

The latch arm 455 includes a first end 402 and a second end 404. The barb 330 is disposed at the second end 404 of the latch arm 455. The latch arm 455 is coupled to the housing 205 by a mounting base 320 in a region of the latch arm 455 between the first and second ends 402, 404. The location of the mounting base 320 allows the first end 402 of the latch arm 455 to function as a lever such that a force applied to the first end 402 of the latch arm 455 causes the second end 404 of the latch arm 455 to be displaced in a manner that moves the barb 330 away from the housing 205. This motion of the barb 330 may be utilized to engage and disengage the cable 400 from the latch receptacle 215 of the I/O card 203.

In at least one embodiment, the barb 330 includes a lip 326 and a sloped surface 325. The lip 326 extends laterally away from a second side 377 of the latch arm 310 facing towards the connector end 317 of the housing 205 and terminates at one end of the sloped surface 325. The sloped surface 325 extends away from the mounting base 320 and terminates at a first side 377 of the latch arm 310 that faces away from the housing 205, thereby defining a point 378 of the barb 330. Similarly as shown in FIG. 3, the point 378 of the barb 330 extends a distance 393 beyond a connector end 317 to ensure that the barb 330 engages and mates with the latch receptacle 215 formed in the latching bracket 220 of the I/O card 203 upon insertion of the connector 110 into the receptacle 115.

The barb 330 has a barb height 365 that is less than a height 360 of the latch receptacle 215 formed through the latching bracket 220 of the I/O card 203, thereby allowing the barb 330 to enter the latch receptacle 215 when the I/O cable assembly 200 is mated with the I/O card 203. The difference between the barb height 365 and the thickness 355 defines a length 370 of the barb lip 326. The length 370 of the barb lip 326 is selected to provide a surface that locks against a back surface 327 of the face plate 290 as to prevent the connector 110 from becoming inadvertently disengaged from the I/O card 203.

When the barb 330 of the I/O cable 400 is interested into the latch receptacle 215, the sloped surface 325 contacts the surfaces of the face 290 surrounding the latch receptacle 215, thereby causing the latch arm 210 to deflect and/or rotates about the mounting portion 320, thus allowing the barb 330 to enter the latch receptacle 215. Once the barb 330 is through the face 290 and the connector 110 is mated with the receptacle 115, sloped surface 325 is no longer engaged with the I/O housing bracket 220, thereby removing the force that had displace the latch arm 210 and allowing the latch arm 210 to spring back to its original position and leaving the lip 326 engaged with the back surface 327 of the I/O housing bracket 220 and thus securely locking the I/O cable 400 to the I/O card 203.

To remove the I/O cable 400 to the I/O card 203, the first end 402 of the latch arm 210 is manually displaced towards the housing 205 causing the second end 404 of the latch arm 210 to rotate about the mounting portion 320 away from the housing 205. This motion displaces the barb 330 in a manner that allows the lip 326 to pass out the latch receptacle as the I/O cable 400 is disengaged from the I/O card 203. The external latch 210 shown in FIG. 3 and FIG. 4 represent just two configurations for securing the I/O cable assembly 400 to the I/O card 203. The external latch 210 may alternatively be a pinch type latch, a detent latch or other type of latch. One knowledgeable in the arts may choose a suitable configuration for an externally latching I/O cable housing 205 that takes advantage of low production costs and the beneficial configuration offered by this invention.

Figure 5:
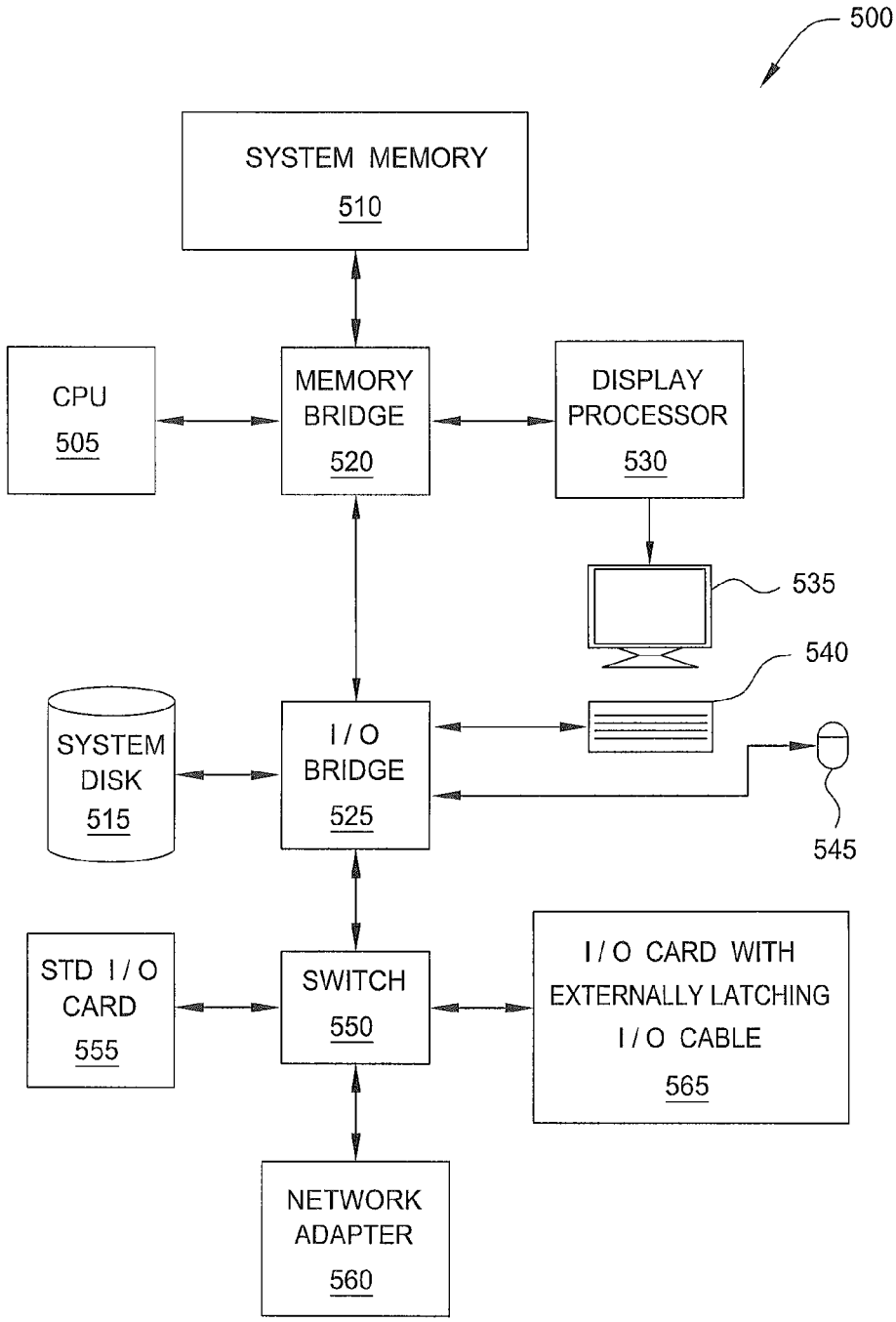
FIG. 5 illustrates a computing device in which one or more embodiments of the present invention can be implemented.

FIG. 5 depict one architecture of a computing system 500 within which embodiments of the present invention may be implemented. This figure in no way limits or is intended to limit the scope of the present invention. The computing system 500 may be a personal computer, video game console, electronic equipment, or any other device suitable for practicing one or more embodiments of the present invention. As shown, computing system 500 includes a central processing unit (CPU) 505 and a system memory 510 communicating via a bus path that may include a memory bridge 520. CPU 505 may include one or more processing cores, and, in operation, CPU 505 is the master processor of system 500, controlling and coordinating operations of other system components. System memory 510 may contain software applications and data for use by CPU 505. CPU 505 runs the software applications and optionally an operating system. Memory bridge 520, which may be, e.g., a northbridge chip or integrated into the CPU 505, is connected via a bus or other communication path (e.g., a HyperTransport link) to an I/O (input/output) bridge 525. I/O bridge 525, which may be, e.g., a southbridge chip or other chip such a CPU 505, receives user input from one or more user input devices (e.g., keyboard 540, mouse 545, joystick, digitizer tablets, touch pads, touch screens, still or video cameras, motion sensors, and/or microphones) and forwards the input to CPU 505 via memory bridge 520.

A display processor 530 is coupled to the memory bridge 520 via a bus or other communication path (e.g., a PCI Express, Accelerated Graphics Port, or HyperTransport link); in one embodiment display processor 520 is a graphics subsystem that includes at least one graphics processing unit (GPU) and graphics memory. Graphics memory includes a display memory (e.g., a frame buffer) used for storing pixel data for each pixel of an output image. Graphics memory can be integrated in the same device as the GPU, connected as a separate device with the GPU, and/or implemented within system memory 510.

Display processor 530 periodically delivers pixels to a display device 535 (e.g., a screen or conventional CRT, plasma, OLED, SED or LCD based monitor or television). Additionally, display processor 530 may output pixels to film recorders adapted to reproduce computer generated images on photographic film. Display processor 530 can provide display device 535 with an analog or digital signal. In one embodiment, display processor 530 has an I/O card 203 with one or more I/O receptacles 115 configured to receive an externally latching I/O cable, such as the cable assemblies 200 and 400. In another embodiment, display 535 has a similarly configured I/O port and is attached to the display processor with an externally latching I/O cable.

A system disk 515 is also connected to I/O bridge 525 and may be configured to store content and applications and data, such as a database library, for use by CPU 505 and display processor 530. System disk 515 provides non-volatile storage for applications and data and may include fixed or removable hard disk drives, flash memory devices, and CD-ROM, DVD-ROM, Blu-ray, HD-DVD, or other magnetic, optical, or solid state storage devices.

A switch 550 provides connections between I/O bridge 525 and other components such as a network adapter 560 and various add-in cards 555 or I/O cards 565. Network adapter 560 allows system 500 to communicate with other systems via an electronic communications network, and may include wired or wireless communication over local area networks and wide area networks such as the Internet. Add-in cards 555 and I/O cards 565 may be configured with a latch receptacle to receive externally latching I/O cables.

Other components (not shown), including USB or other port connections, film recording devices, and the like, may also be connected to I/O bridge 525. For example, a video processor may be used to generate analog or digital video output from instructions and/or data provided by CPU 505, system memory 510, or system disk 515. Communication paths interconnecting the various components in FIG. 5 may be implemented using any suitable protocols, such as PCI (Peripheral Component Interconnect), PCI Express (PCI-E), AGP (Accelerated Graphics Port), HyperTransport, or any other bus or point-to-point communication protocol(s), and connections between different devices may use different protocols, as is known in the art.

In one embodiment, display processor 530 incorporates circuitry optimized for graphics and video processing, including, for example, video output circuitry, and constitutes a graphics processing unit (GPU). In another embodiment, display processor 530 incorporates circuitry optimized for general purpose processing. In yet another embodiment, display processor 530 may be integrated with one or more other system elements, such as the memory bridge 520, CPU 505, and I/O bridge 525 to form a system on chip (SoC). In still further embodiments, display processor 530 is omitted and software executed by CPU 505 performs the functions of display processor 530.

It will be appreciated that the system shown herein is illustrative and that variations and modifications are possible. The connection topology, including the number and arrangement of bridges, may be modified as desired. For instance, in some embodiments, system memory 510 is connected to CPU 505 directly rather than through a bridge, and other devices communicate with system memory 510 via memory bridge 520 and CPU 505. In other alternative topologies display processor 530 is connected to I/O bridge 525 or directly to CPU 505, rather than to memory bridge 520. In still other embodiments, I/O bridge 525 and memory bridge 520 might be integrated into a single chip. The particular components shown herein are optional; for instance, any number of add-in cards or peripheral devices might be supported. In some embodiments, switch 550 is eliminated, and network adapter 560, add-in cards 555, and an I/O card 565, supporting externally latching I/O cables, are connect directly to I/O bridge 525.

While the foregoing is directed to embodiments of the present invention, other and further embodiments of the invention may be devised without departing from the basic scope thereof, and the scope thereof is determined by the claims that follow.

What is claimed is:

1. An external latching mechanism for an Input/Output (I/O) connector, the external latching mechanism comprising:

an I/O cable;

a housing coupled to the I/O cable at a first end and having an I/O connector extending from a second end, wherein the I/O connector is adapted to mate with a connector receiving opening; and an external latch adapted to mate with an I/O latching bracket having a latch receptacle that is separated from the connector receiving opening by a bracket wall, the external latch comprising:

an arm having a first end and a second end, the second end of the arm extending beyond the second end of the housing;

a barb coupled to the second end of the arm, the barb spaced from the housing a distance to allow the barb to engage the latch receptacle when the I/O connector is inserted into the connector receiving opening; and a mounting portion connecting the arm to the housing.

2. The external latching mechanism of claim 1, wherein the first end of the arm is connected to the mounting portion in a cantilevered configuration.

3. The external latching mechanism of claim 1, wherein mounting portion is connected the arm between the first end and the second end of the arm, the arm operable to displace the second end of the arm away from the housing in response to a force applied to the first end of the arm.

4. The external latching mechanism of claim 1, wherein the barb comprises:

a lip and a sloped surface, the lip extending laterally away from the arm and towards the housing.

5. The external latching mechanism of claim 1, wherein the barb comprises:

a lip and a sloped surface disposed at opposite ends of the barb, the lip extending laterally away from the arm and towards the housing.

6. The external latching mechanism of claim 1, wherein the I/O connector comprises a mini display port connector.

7. The external latching mechanism of claim 1, wherein the housing is removable from the I/O cable.

8. The external latching mechanism of claim 1, wherein the external latch is over-molded to the housing.

9. The external latching mechanism of claim 8, wherein the external latch comprises a material harder than the housing.

10. The external latching mechanism of claim 1, wherein the external latch and the housing are comprised of different materials.

11. The external latching mechanism of claim 1 wherein the latching bracket further comprises:

a plurality of cable connector receiving openings; and a plurality of latch receptacles, each latch receptacle sized to mate with the barb and associated with a respective one of the connector receiving openings.

12. The external latching mechanism of claim 11, wherein the plurality of latch receptacle are linearly aligned.

13. The external latching mechanism of claim 12, wherein the plurality of connector receiving openings are linearly aligned in parallel with the latch receptacles.

14. An external latching Input/Output (I/O) connection comprising:

a I/O card latching bracket configured for coupling to an I/O card, the latching bracket comprising:

a plurality of cable receiving openings having a linear alignment; and a plurality of latch receptacles having a linear alignment, parallel and separated from the plurality of cable receiving openings by a bracket wall; and an I/O cable assembly comprising;

an I/O cable;

a housing having a first end and a second end, the first end coupled to the I/O cable;

an I/O connector extending from the second end of the housing; and an arm coupled to the housing extending beyond the second end of the housing to a barb, the barb spaced from the housing a distance to allow the barb to engage the latch receptacle when the I/O connector is inserted into the cable receiving opening associated with the latch receptacle.

15. The external latching Input/Output (I/O) connection of claim 14, wherein the arm is connected to the mounting portion in a cantilevered configuration.

16. The external latching Input/Output (I/O) connection of claim 14, wherein the I/O cable assembly further comprises:

a mounting portion connecting the housing to the arm, the arm operable to displace the barb away from the housing in response to a force applied to an end of the arm opposite the barb.

17. The external latching Input/Output (I/O) connection of claim 14, wherein the I/O connector comprises a mini display port connector.

18. The external latching Input/Output (I/O) connection of claim 14, wherein the housing is removable from the I/O cable.

19. The external latching Input/Output (I/O) connection of claim 14, wherein the external latch and housing are comprised of different materials.

20. The external latching mechanism of claim 1, wherein the external latch and the housing comprise a single unitary component.

* * * * *

UNITED STATES PATENT AND TRADEMARK OFFICE

CERTIFICATE OF CORRECTION

PATENT NO. : 9,106,013 B2
APPLICATION NO. : 13/718262
DATED : August 11, 2015
INVENTOR(S) : Trevor Boswell et al.

It is certified that error appears in the above-identified patent and that said Letters Patent is hereby corrected as shown below:

In the claims,

Column 10, line 62, Claim 11, please delete "cable".

Signed and Sealed this
First Day of March, 2016

Michelle K. Lee

Michelle K. Lee
*Director of the United States Patent and Trademark Office*